United States Patent [19]

Patelis

[11] 4,185,591

[45] Jan. 29, 1980

[54] TRANSPORT AND RECOVERY BED FOR HORSES

[76] Inventor: James Patelis, 7 Ruth Dr., Hicksville, N.Y. 11801

[21] Appl. No.: 932,280

[22] Filed: Aug. 9, 1978

[51] Int. Cl.[2] ..... A61D 3/00

[52] U.S. Cl. ..... 119/98; 119/102; 119/103

[58] Field of Search ..... 119/103, 100, 101, 102, 119/27, 98; 5/370, 371

[56] References Cited

U.S. PATENT DOCUMENTS

| | | | |
|---|---|---|---|
| 541,920 | 7/1895 | Cunningham | 119/100 |
| 1,788,924 | 1/1931 | Marrinian et al. | 119/103 |
| 3,621,819 | 11/1971 | Hooper | 119/102 |
| 3,807,361 | 4/1974 | Kaplan | 119/102 |
| 4,070,989 | 1/1978 | Ganzel | 119/27 |

*Primary Examiner*—Hugh R. Chamblee

*Attorney, Agent, or Firm*—James P. Malone

[57] ABSTRACT

Stretcher for horses. A split cart having elevatable wheels is connected to be locked together. A split resilient bed is mounted in the cart. The bed has apertures for receiving the legs of a horse so that the split cart with bed may be slid under a horse, locked together and elevated for transportation. The device may be used for recovery after surgery.

9 Claims, 5 Drawing Figures

TRANSPORT AND RECOVERY BED FOR HORSES

This invention relates to means for transporting injured animals, for instance, horses.

Quite often horses fall down and break their legs during a race. On many occasions, the horses have to be destroyed because it is not possible to handle them sufficiently well so that the broken leg can be set and the horse handled and restrained in such a manner so that it will not break the cast and reinjure the leg.

Since many race horses are quite valuable there is a neeed for apparatus of this type. Since horses weigh in a neighborhood of fifteen hundred pounds it is very difficult to handle them when they have an injured or broken leg. Temporary compressed air splints are generally applied. However, in addition to this, it is necessary to take the horse's weight off the leg as much as possible and restrain it so that the horse will not reinjure the leg.

Prior devices, such as shown in U.S. Pat. No. 4,070,989 show resilient transportable bed means for horses. However, in the device of this type the horse has to be elevated higher than the length of the horse's legs and then lowered into the bed device. Since the horse weighs about fifteen hundred pounds and is difficult to control, this operation requires a large size hoisting derrick.

With the split cart bed of the present invention, once the horse is gotten up on its legs, the bed can be slid under the horse and then the cart locked together and elevated to take the weight off the legs for transportation.

Accordingly, a principal object of the invention is to provide new and improved transportation and handling means for injured animals, such as horses.

Another object of the invention is to provide new and improved transportation and handling means for injured animals, such as horses comprising a split cart having wheels, each half of the cart containing a resilient bed with apertures to accommodate the horse's legs.

Another object of the invention is to provide new and improved handling and transporting means for horses comprising, a split cart having wheels, means connected to lock the split cart together, a split resilient bed mounted in said cart, said bed having apertures for receiving the legs of a horse whereby the split cart with bed may be slid under a horse, locked together and elevated for transportation.

These and other objects of the invention will be apparent from the following specification and drawings of which:

Figure 3:
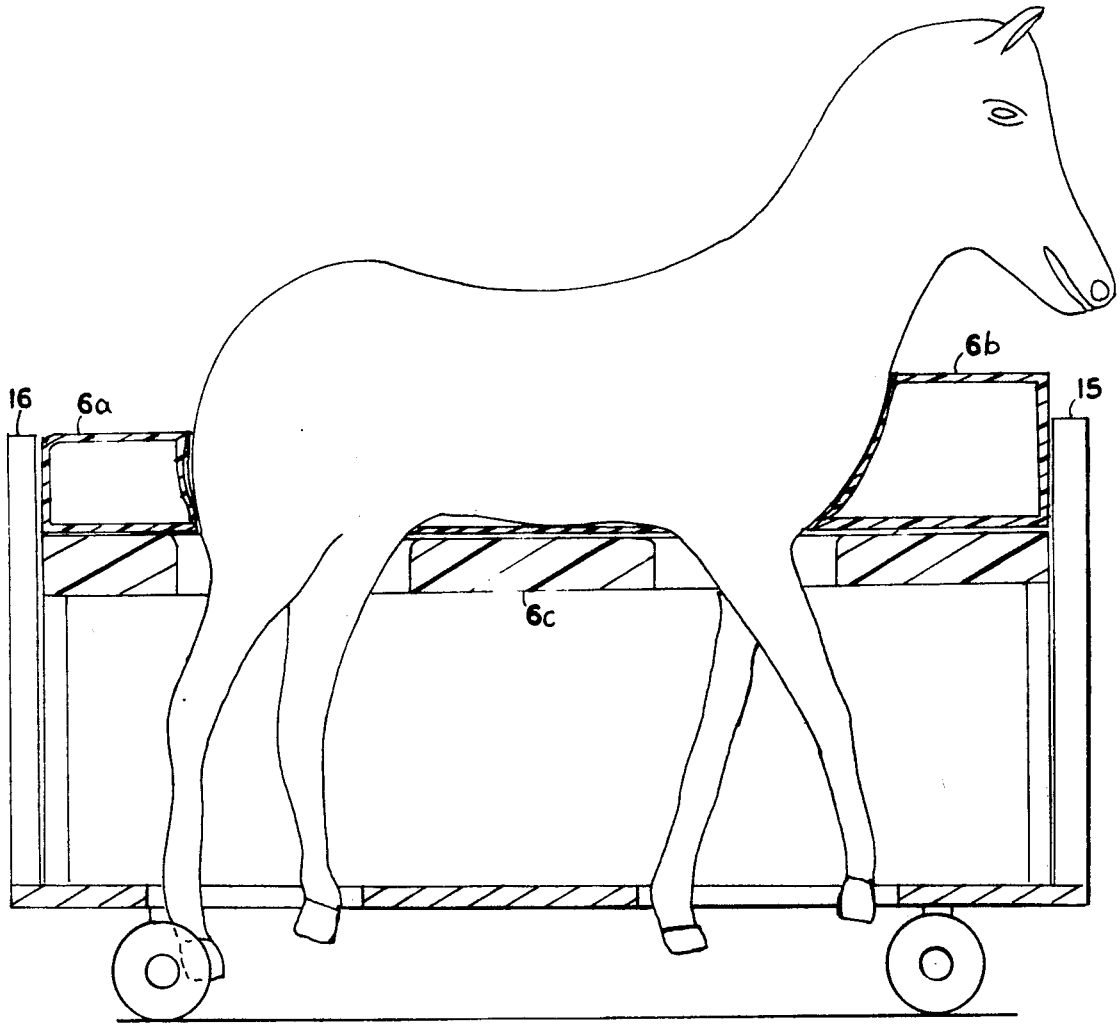
FIG. 3 is a side view partly in section of the invention.

Referring to the drawings, the invention comprises a split cart having two portions, 1 and 2, which are adapted to be locked together by means of the slides 3 and 4. Each half of the cart contains a resilient bed 5 and 6 with apertures 5', 6', etc. for accommodating the legs of the horse, as shown in FIG. 3.

More specifically, each half of the cart comprises a bottom portion 10 and 11 upon which are mounted corner members 12, 13, 14, etc. Side and end panels 15, 16, etc., are adapted to be mounted in the corner posts. These are preferably removably mounted in slots in the corner posts. The cart is locked together with pins 18, 19, etc. The bottom of the cart is apertured like the inflatable bed members.

Each half of the cart has a resilient bed 5 and 6, with apertures 5', 6', 7', 8', etc. The bed is preferably made of a strong cover such as canvas and the resiliency may be provided by water, compressed air or a gel substance. The use of water or air provides easier adjustment of the bed. Air is preferable, as it is lighter and easier and quicker to inflate and deflate for adjustment purposes.

Figure 1:
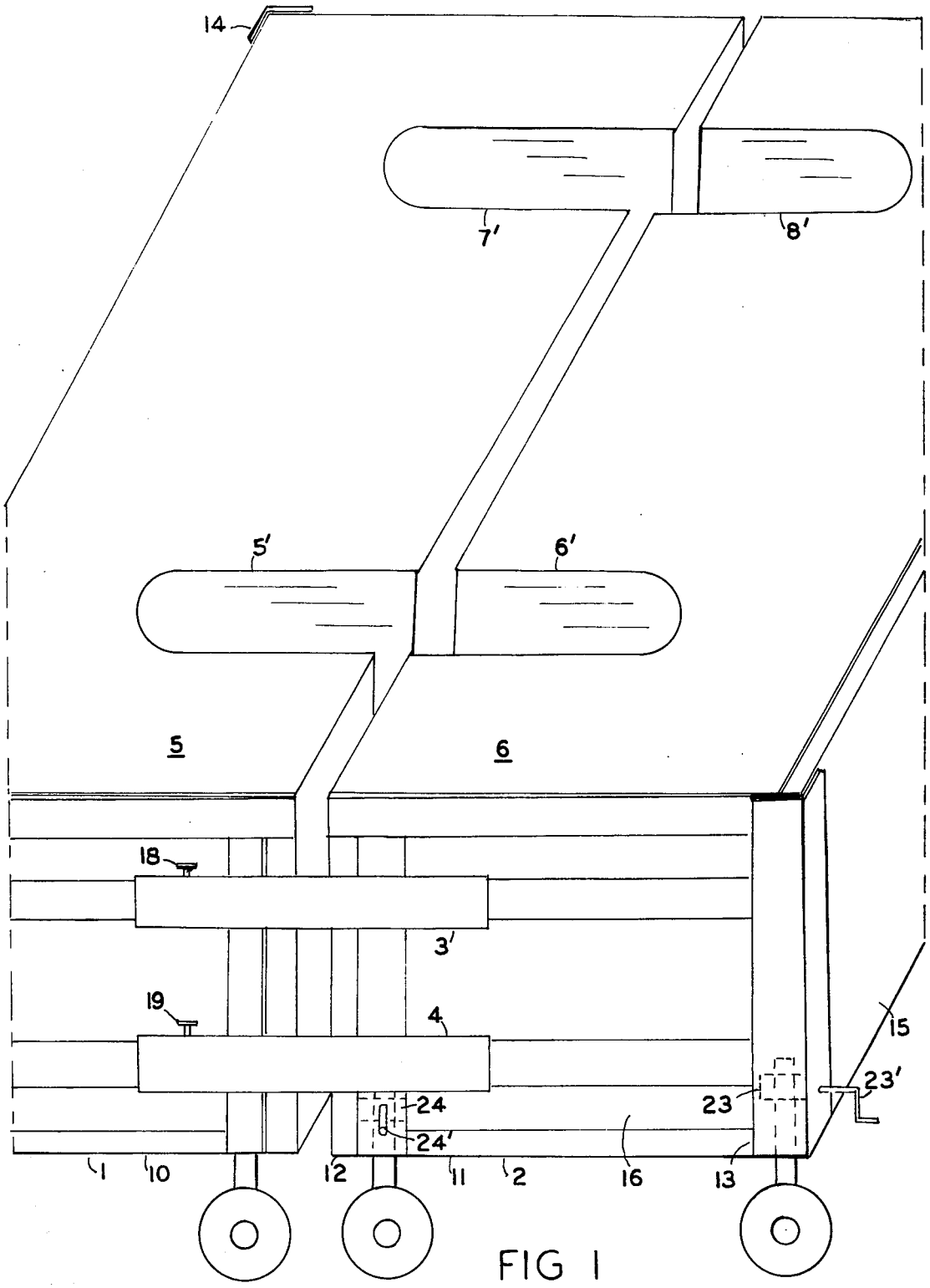
FIG. 1 is a perspective view of an embodiment of the invention.
Figure 2:
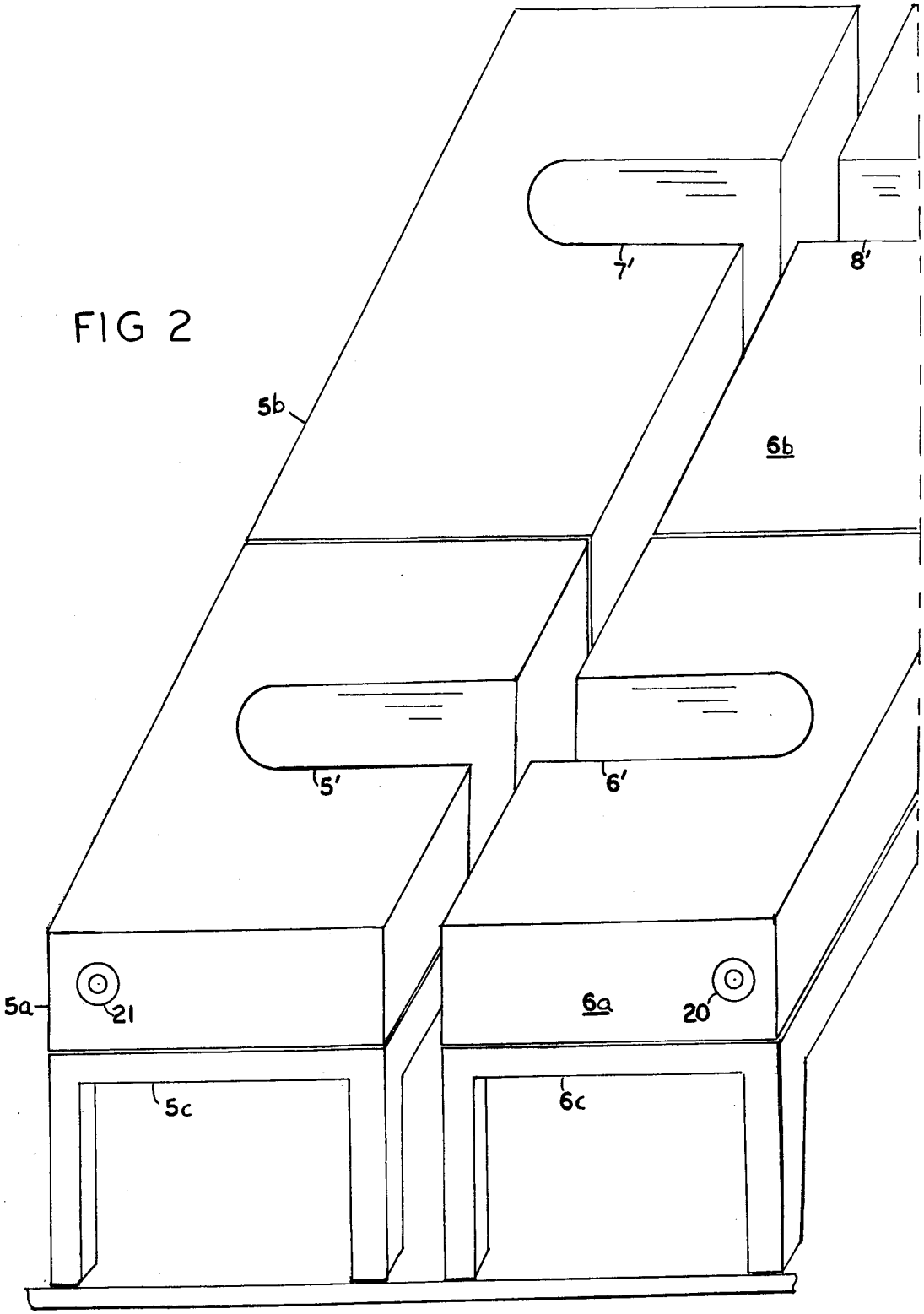
FIG. 2 is a detail view of resilient bed with apertures for the horse's legs.

Referring to FIG. 2, the bed 5 and 6, is preferably formed of sections *5a*, *5b*, *6a*, *6b*, for easier handling. If the bed uses compressed air or water then suitable valves 20, 21, etc. are provided. The height of the bed is controlled by the valves and a compressed air supply. For instance, the front of the bed could be inflated to take weight off the front legs. The bed rests on tables *5c*, *6c*, which fit inside the split cart.

The cart is preferably arranged to be elevated by means of wheel jacks 23, 24, etc., having handles 23', 24', etc. The wheel jacks may be similar to conventional jacks which include a large threaded shaft which is elevated by gears turning the shaft in order to elevate the wheels. Similar devices are used on boat trailers and other transportation devices. The wheel jacks are preferably motor driven for easier manipulation. Small electric motors with large gear ratios may be used which may be powered by a battery mounted on the cart.

FIG. 3 shows a horse mounted in the cart on bed *6a*, *6b*. Bed *6b* is inflated higher than bed *6a* to take the weight off the front feet.

In operation, when a race horse, for instance, breaks a leg, a temporary compressed air splint is generally applied immediately. With the horse standing erect the present split cart is then pushed in from both sides of the horse, locked together and elevated. The weight of the horse is distributed over the resilient bed as desired, by selective inflation of the bed portions. The movement of the injured legs is restrained by the resilient bed to minimize any further injuries. The injured horse can then be easily pushed to the Veterinary Department to start treatment. The transport cart may be coupled to a tractor or other vehicle.

Figure 4:
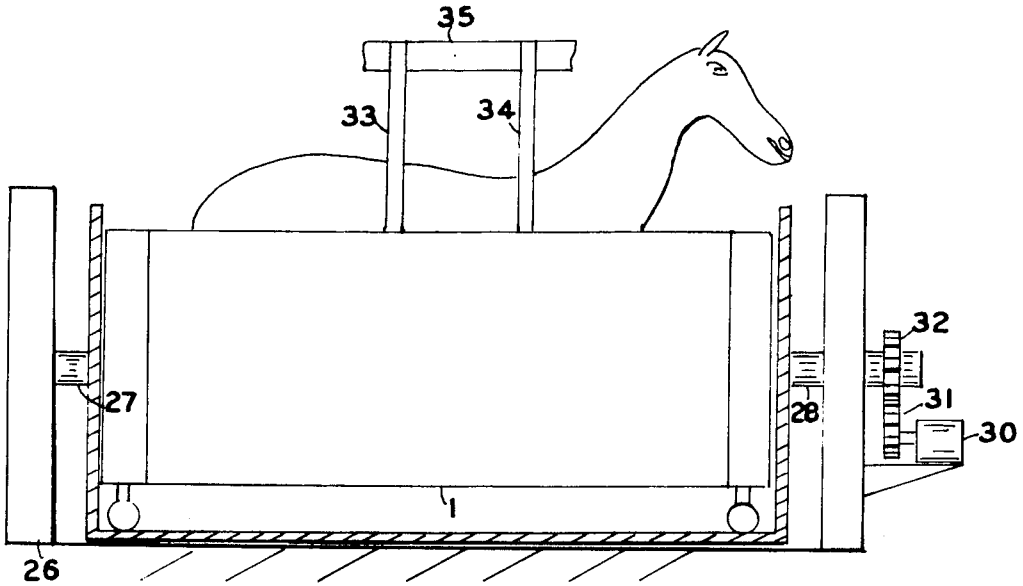
FIG. 4 is a side view of an embodiment of the invention.

The device may also be used to move the horse onto an operating table as shown in FIG. 4. The entire cart may be rolled into a cradle 26, which is mounted on trunnions 27, 28. The cradle may be rotated by means of motor 30 and gears 31, 32, to a horizontal position. The horse is now positioned for surgery. During this procedure, the position of the horse should be stabilized by means of slings 33, 34, mounted on the overhead member 35 or on the ceiling or a wall extension, or any other convenient solid structure.

The present device is also useful for post-operative handling and rehabilitation since it will serve to keep the weight off the injured leg and also restrain movement of the injured leg. Horses are sometime placed into swimming pools for this purpose. However, the swimming pool does not restrain movement of the injured leg. If the injured leg which has a cast on is not restrained the cast may be broken by the horse kicking the leg.

Figure 5:
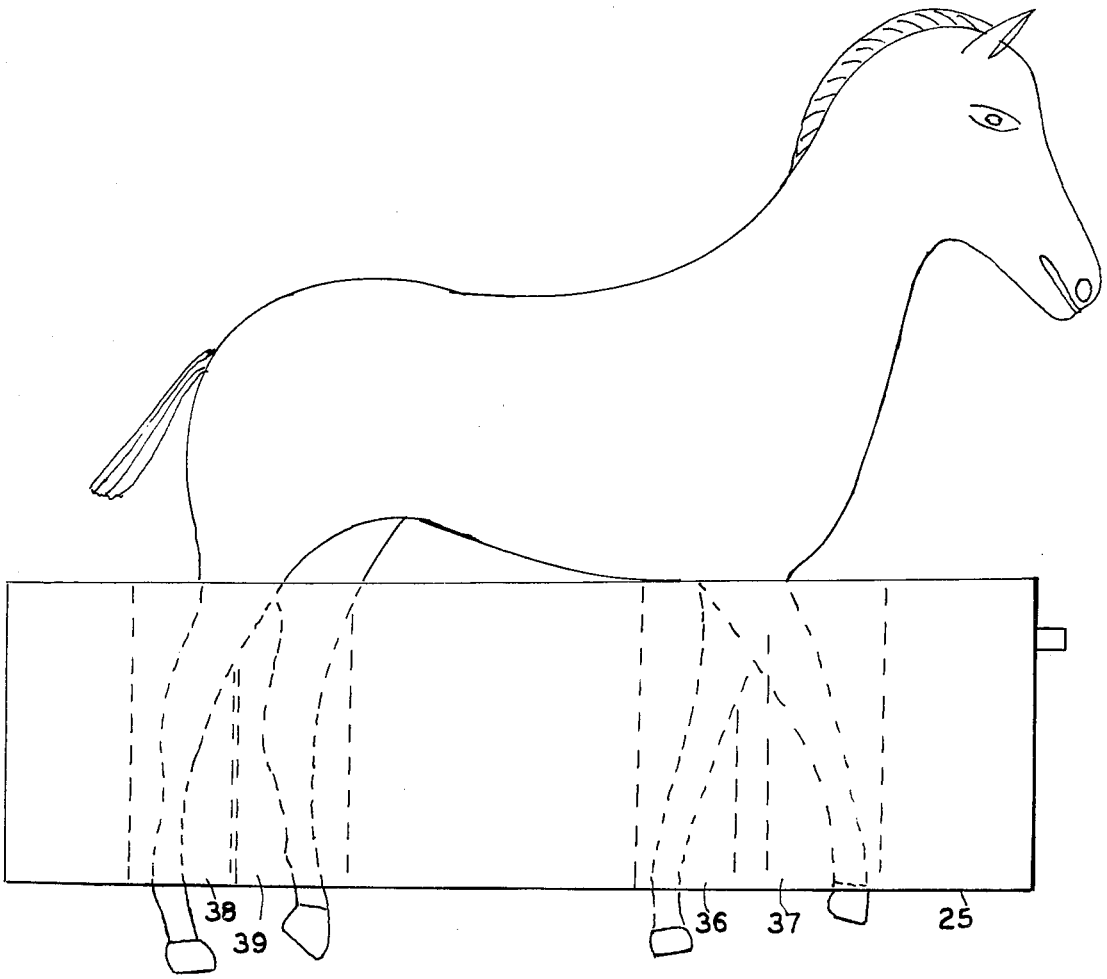
FIG. 5 is a side view of an inflatable orthopedic brace for use with the invention.

FIG. 5 shows a horse mounted in a resilient orthopedic brace 25 which is shown elevated off the ground. This may be a one piece inflated member which may be inserted in the split cart. Note that the body of the horse will sink into the resilient bed so that he will be stably supported. However, if desired, slings could be applied to stabilize the position of the horse.

The device is also useful for recovery after surgery. After surgery, instead of placing the horse in a recovery stall on the floor, the horse is slid back into the movable bed during recovery and an orthopedic brace 25, FIG. 5, should be placed on the injured leg to prevent the horse from kicking off the cast. The orthopedic brace is preferably an inflated member with apertures 36, 37, 38, 39, which fit around the injured leg and restrain its movement. The orthopedic brace 25 may be mounted in the split cart.

It is claimed:

1. Stretcher means for horses comprising:

a split cart having first and second half cart portions each portion having wheels, means mounted on the first portion and adapted to be connected to lock the split cart together, a split resilient bed mounted in said cart, said bed having apertures for receiving the legs of a horse whereby the split cart with bed may be slid under a horse, and locked together for transportation.

2. Apparatus as in claim 1 wherein the resilient bed is a water bed.

3. Apparatus as in claim 1 wherein the resilient bed is a gel bed.

4. Apparatus as in claim 1 wherein the resilient bed is an air bed.

5. Apparatus as in claim 1 having means connected to the cart to elevate the cart.

6. Apparatus as in claim 5 wherein the means to elevate the cart are screw-jacks connected to the wheels.

7. Apparatus as in claim 1 wherein the bed has a plurality of separate portions.

8. Apparatus as in claim 1 having means connected to rotate the split cart 90°.

9. Apparatus as in claim 1 wherein the bed is an inflatable orthopedic brace.

* * * * *